US009437051B1

(12) United States Patent
Biswas et al.

(10) Patent No.: US 9,437,051 B1
(45) Date of Patent: Sep. 6, 2016

(54) SYSTEMS AND METHODS FOR PROVIDING OPERATIONAL CONTINUITY USING REDUCED DATA REPLICATION

(75) Inventors: Michael J. Biswas, Culver City, CA (US); Pradipe Yoggi, Los Angeles, CA (US)

(73) Assignee: Stamps.com Inc., El Segundo, CA (US)

( * ) Notice: Subject to any disclaimer, the term of this patent is extended or adjusted under 35 U.S.C. 154(b) by 118 days.

(21) Appl. No.: 13/157,969

(22) Filed: Jun. 10, 2011

(51) Int. Cl.
*G07B 17/02* (2006.01)
*G07B 17/00* (2006.01)

(52) U.S. Cl.
CPC ..... *G07B 17/0008* (2013.01)

(58) Field of Classification Search
CPC ..... G07B 17/0008; G07B 2017/00411
See application file for complete search history.

(56) References Cited

U.S. PATENT DOCUMENTS 4,421,977 A * 12/1983 Kittredge ..... 235/101
4,999,481 A * 3/1991 Baer et al. ..... 235/375
5,822,730 A 10/1998 Roth et al.
6,061,671 A * 5/2000 Baker et al. ..... 705/404
6,233,565 B1 * 5/2001 Lewis et al. ..... 705/35
6,865,557 B1 * 3/2005 Cordery et al. ..... 705/60
6,868,406 B1 3/2005 Ogg et al.
6,889,214 B1 5/2005 Pagel et al.
7,752,141 B1 7/2010 Ogg et al.
8,230,256 B1 * 7/2012 Raut ..... 714/13
2008/0301387 A1 * 12/2008 Heinrich ..... 711/162
2009/0287602 A1 * 11/2009 Brunsmann ..... 705/40
2009/0287967 A1 * 11/2009 Winokur ..... 714/54
2011/0047548 A1 * 2/2011 Traut ..... 718/1

OTHER PUBLICATIONS

Microsoft Computer Dictionary, Fifth Edition, Microsoft Press, Redmond, Washington, 2002, pp. front cover, title page, copyright page, and 474.*
Newsbytes, "Cylink Helps USPS Say Goodbye to Licky Sticky Stamps Aug. 14, 1998,"Washingtonpost Newsweek Interactive, Aug. 14, 1998.*
U.S. Appl. No. 12/963,472, Kara et al.

* cited by examiner

*Primary Examiner* — Nathan Erb
(74) *Attorney, Agent, or Firm* — Norton Rose Fulbright US LLP

(57) ABSTRACT

Systems and methods which provide continuity of system operation using relatively little or no data replication between a primary site and alternate site are shown. A user may be provided credit in an amount corresponding to their user balance for performing value operations using systems of the alternate site while systems of the primary site are unavailable. The access to value provided by systems of alternate sites of embodiments of the invention is thus not contingent upon replicating the value stored by the primary site. Although user's individual data representing value may not be accessed during a period in which systems of an alternate site are in use, embodiments of the invention are adapted to reconcile the user balance data with the users' individual data representing value for return to use of the systems of the primary site by respective users.

27 Claims, 2 Drawing Sheets

SYSTEMS AND METHODS FOR PROVIDING OPERATIONAL CONTINUITY USING REDUCED DATA REPLICATION

CROSS-REFERENCE TO RELATED APPLICATIONS

The present application is related to co-pending and commonly assigned U.S. patent application Ser. No. 12/963,472 entitled "System and Method for Remote Postage Metering, "filed Dec. 9, 2010, Ser. No. 12/606,814 entitled "Cryptographic Module for Secure Processing of Value-Bearing Items," filed Oct. 27, 2009, and Ser. No. 12/782,667 entitled "Cryptographic Module for Secure Processing of Value-Bearing Items," filed May 18, 2010, the disclosures of which are hereby incorporated herein by reference.

TECHNICAL FIELD

The invention relates generally to providing system operational continuity and, more particularly, to providing continuity of system operation using relatively little or no data replication between a primary site and alternate site.

BACKGROUND OF THE INVENTION

Various systems have been in use for a number of years which allow individuals and businesses (collectively users) to generate and print postage indicia using personal computers and similar processor-based systems. For example, U.S. Pat. No. 5,822,730 entitled "System and Method for Remote Postage Metering," the disclosure of which is incorporated herein by reference, describes a postage metering system in which processor-based systems communicate with a remote postage metering system in order to obtain and print desired postage indicia. U.S. Pat. No. 6,868,406 entitled "Auditing Method and System for an On-Line Value-Bearing Item Printing System," the disclosure of which is incorporated herein by reference, describes an on-line postage indicia printing system that includes cryptographic modules and a central database used to print desired postage indicia.

Although a number of different user entities may utilize the same remote postage metering system to print postage indicia, each such user entity accesses their individual postage meter account. For example, each user entity (any of all of which may include a plurality of users) may utilize their individual user account having a postage security device (PSD) associated therewith and storing postage meter value for use in generating and printing postage indicia. Such PSDs provide secure storage of an associated user entity's postage meter value for use in metering postage indicia. Accordingly, the PSDs may comprise a processor, cryptographic algorithms, secure memory, tamper proof housing, etc.

The PSDs for the different user entities may be virtualized, such as through the use of a crypto-card or similar secure hardware and a plurality of vault files, whereby loading a particular user entity's vault file into the crypto-card configures the crypto-card as that user entity's PSD. The vault files may be protected when stored external to the crypto-card using cryptographic or other techniques (e.g., the contents of a user entity's PSD data may be encrypted as a vault file until loaded into an appropriate crypto-card for operation as the user entity's PSD). Accordingly, the physical requirements for PSDs to serve a number of user entities by a remote postage metering system can be reduced while still providing the requisite number of individual user accounts having a virtual PSD associated therewith. Embodiments of remote postage metering systems implementing such virtualized PSDs are shown in U.S. Pat. No. 6,889,214 entitled "Virtual Security Device," the disclosure of which is incorporated herein by reference.

Irrespective of whether individual PSDs or virtualized PSDs are implemented, the PSDs and the use thereof involves operation to protect the postage meter value. Specifically, the PSD proscribes security protocols for protecting the postage meter value and deterring fraud because the postage meter value is evidence of monetary value (e.g., essentially cash value). For example, the PSD may store multiple registers, such as an ascending register (e.g., storing the total amount of postage indicia value passed through the PSD), a descending register (e.g., storing the current postage meter value), and a strike counter (e.g., storing the total number of postage indicia created using the PSD) used to provide fraud prevention/detection. Additionally, the PSD may implement cryptographic protocols when storing postage meter value and/or other information to obscure the data and provide fraud prevention. Protocols implemented by the PSD control the incrementing and decrementing of the postage meter value, updating of various registers, etc.

Additionally, various proscriptions on the handling, storage, and use of the postage meter value and other PSD data may be mandated by an associated entity. For example, in the postage industry there is a complicated set of encryption protocols, digital signatures, and authentication codes that support the ability to protect the integrity of the PSD data and provide proof to a postal service (the United States Postal Service (USPS)) the postage meter value has not been tampered with. Accordingly, where the postage meter value comprises value usable in a postal service such as the USPS, the postal service may mandate procedures for handling meter value, vault files, etc. In particular, only one amount of value is represented by potentially numerous copies of the PSD data (e.g., vault file), which may be accidentally or fraudulently used to evidence value in excess of the one true amount of value (e.g., the total of the value of each such copy of PSD data). Therefore, postal service procedures may restrict the transmission of the data, the duplication of the data, etc.

The users of postage metering systems often rely upon the postage metering service in conducting business operations and/or personal affairs. In particular, users of remote postage metering systems operable to generate and print postage indicia through personal computers and similar processor-based systems often utilize such systems to generate and print postage indicia on demand, as needed. Accordingly, a high level of availability with respect to the postage metering service is demanded by the users.

Providing fault tolerant redundancy with respect to postage meter value is problematic for a number of reasons. For example, if an alternate remote postage metering system site were established to mirror a primary remote postage metering system site a significant amount of data may need to be exchanged (e.g., updated vault files for each PSD for which a transaction has occurred). The need to transmit voluminous data may prove problematic both to generate (e.g., creating copies of individual vault files) and transmit in real-time without providing significant resources, particularly in light of the processing loads often placed on the postage metering system in serving the user demands for postage indicia. Moreover, the procedures mandated by an associated entity (e.g., postal service) may proscribe or otherwise restrict particular activities implemented in such a mirroring technique, such as by preventing the duplication (e.g., copying) of postage meter value, the transmission of postage meter value via public network, etc. Such restrictions may not only be problematic in establishing mirrored fault tolerant redundancy, but may prevent practicable implementations of such techniques.

Even if difficulties associated with providing the resources needed to provide the data mirroring and restrictions on the activities implemented with respect to postage meter value and/or other PSD data were to be overcome, further issues would be experienced with respect to the use of a primary remote postage metering system site PSD and its corresponding alternate postage metering system site PSD. For example, where the alternate site PSD were used to generate postage indicia, decrementing a copy of the postage meter value stored thereby, while the primary site is inoperable, there remains the issue of reconciling the alternate site PSD and the primary site PSD when the primary site is again operable. Each such PSD is storing data to be treated as evidence of value, yet only one amount of value is actually represented by the postage meter value stored by these two devices. Any reconciliation of the postage value between these devices must be carefully undertaken to assure that value is not erroneously lost or added. Currently there is no procedure for reconciling postage meter value stored by a primary site PSD and an alternate site PSD.

BRIEF SUMMARY OF THE INVENTION

The present invention is directed to systems and methods which provide continuity of system operation using relatively little or no data replication between a primary site and alternate site. Embodiments of the invention provide systems of an alternate site for serving user directed value operations (e.g., requests associated with postage meter value), in the event of unavailability of systems of a primary site, without implementing duplication of data representing value (e.g., individual user's postage meter value stored by primary site PSDs). Instead, systems of the alternate site provide user directed value operations using alternate data representing value (e.g., service provider's postage meter value stored by alternate site PSDs).

A relatively small amount of data may be shared by the primary site systems and alternate site systems (e.g., user balance information) to facilitate user directed value operations using the alternate data representing value. In operation according to embodiments of the invention, a user is provided credit in an amount corresponding to their user balance for performing user directed value operations using the systems of the alternate site while the systems of the primary site are unavailable. Accordingly, the use of user balance data as implemented according to embodiments of the invention provides users with access to value of the alternate data representing value which is shared by a plurality of users, rather than the user's being provided access to value of their individual data representing value as provided by operation of systems of a primary site. The access to value provided by systems of alternate sites of embodiments of the invention is thus not contingent upon replicating the data representing value.

The use of such user balance data for accessing the alternate data representing value according to embodiments provides a credit layer between the user and the data representing value to manage the user balance data which is not present with respect to operations using individual data representing value at the primary site. Such a user balance credit management layer of embodiments facilitates the use of user balance information for value debit operations, value credit operations, value inquiry operations, etc.

Embodiments of the present invention provide operation to support a seamless transition back to use of systems of a primary site after use of systems of an alternate site. For example, although user's individual data representing value may not be accessed during a period in which systems of an alternate site are in use (e.g., a period in which alternate data representing value is used), embodiments of the invention are adapted to reconcile the user balance data with the users' individual data representing value for return to use of the systems of the primary site by respective users. Moreover, embodiments of the invention are adapted to coordinate refunds associated with value accessed using the alternate data representing value which are received after a return to using the user's individual data representing value.

Primary site systems and alternate site systems adapted according to embodiments of the invention are operable to meet relatively short recovery time and recovery point objectives. For example, systems of an alternate site herein are preferably operated in a standby mode for immediate redirection of user requests in the event of the unavailability of systems of the primary site, thereby proving a recovery time on the order of seconds (e.g., the time for instructing routers or other network equipment to redirect communications). Systems of an alternate site herein are additionally or alternatively provided updated information for facilitating user directed value operations in real-time or near real-time (e.g., as user transactions are completed) by systems of the primary site, thereby providing a recovery point on the order of seconds (e.g., the latency associated with collecting and transmitting user balance update information upon completion of a transaction).

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1:
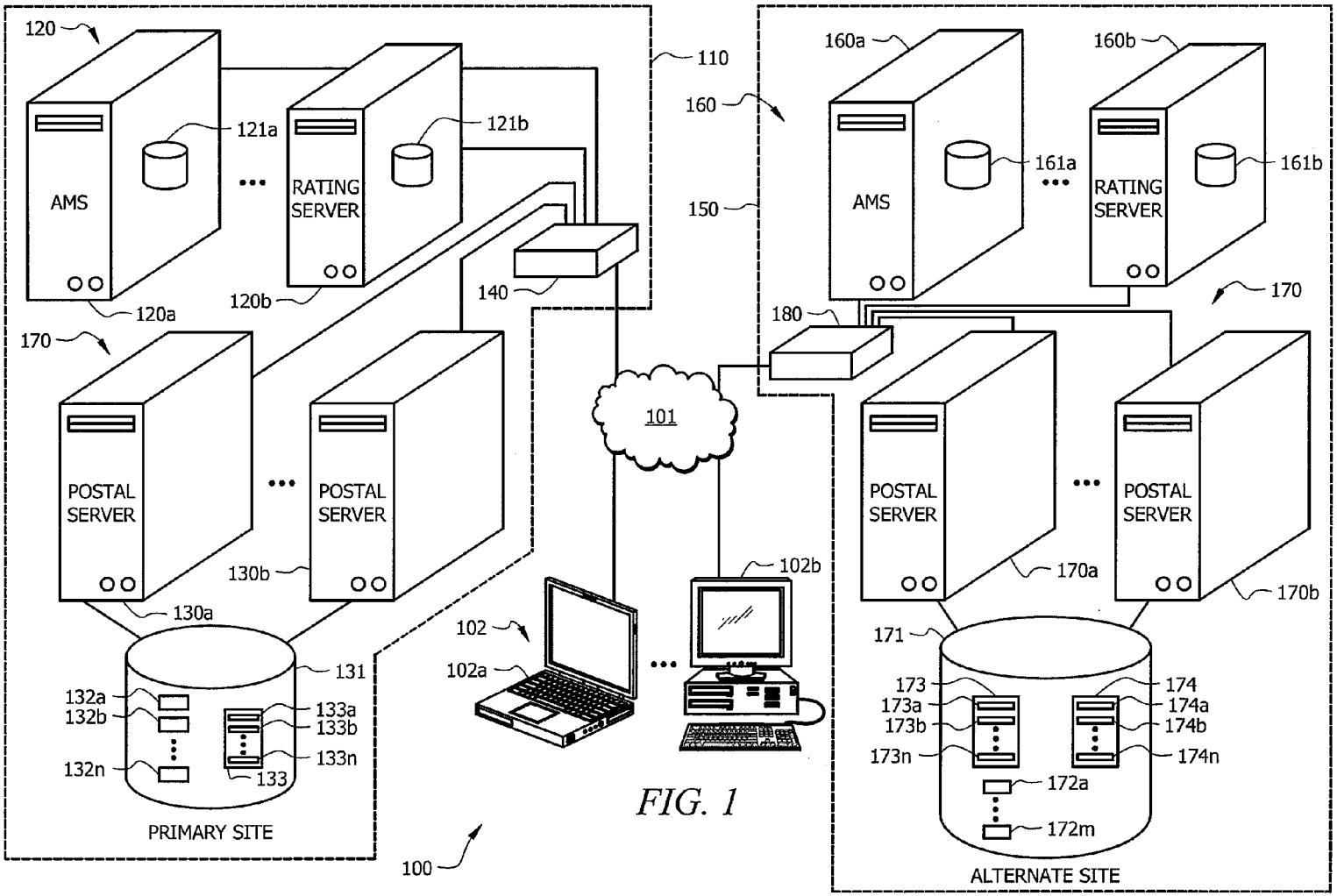
FIG. 1 shows a system adapted according to embodiments of the invention.

FIG. 1 shows a system adapted according to embodiments of the invention. Specifically, system 100 shown in FIG. 1 includes systems of primary site 110 and systems of alternate site 150 adapted to provide continuity of system operation using relatively little or no data replication between primary site 110 and alternate site 150. In discussing the embodiment illustrated in FIG. 1 reference is made to a primary site and an alternative site. Such sites, however, need not be single locations. For example, the systems of primary site 110 and/or alternate site 150 may be distributed over a plurality of locations. Moreover, a primary site and alternate site need not comprise mutually exclusive locations according to embodiments of the invention. For example, one or more system of primary site 110 may be co-located with one or more system of alternate site 150 in an embodiment of the invention.

In order to aid the reader in understanding the concepts of the present invention exemplary embodiments will be described herein with reference to postage meter value and postage metering operations. In particular, operation of primary site 110 and alternate site 150 will be described with respect to their operation in providing remote postage metering services to provide illustration of the application of the concepts herein. It should be appreciated, however, that the concepts herein are applicable to various other use models having data representing value. For example, embodiments of the invention may be provided with respect to prepaid goods and services such as gift card processing, prepaid calling services, electronic commerce account servicing, etc.

Systems of primary site 110 are operable for serving user directed value operations. For example, postal servers 130 may be configured to control postage meter value responsive to user requests, thereby providing remote postage metering services. Postal servers 130 may comprise crypto-cards or similar secure hardware (not shown) operable with a plurality of vault files (shown as vault files 132*a*-132*n* stored by database 131) to provide virtual PSD operation for metering postage value for a plurality of users, whereby loading a particular user's vault file (e.g., vault file 132*a* for a first user or user entity, vault 132*b* for a second user or user entity, etc.) into the crypto-card configures the crypto-card as that user's PSD for accessing the users' data representing value stored in the vault files.

It should be appreciated that systems of primary site 110 may utilize information in addition to the foregoing data representing value and associated PSD data. For example, information used in facilitating user directed value operations may include user account data (e.g., user account data 133 stored in database 131), such as may include user identification (e.g., user, user entity name, etc.), user account credentials (e.g., password, digital signature, cryptographic key, user terminal fingerprint, etc.), user account parameters (e.g., account restrictions, account features, etc.), and/or the like. User account data may, for example, comprise information (e.g., user account data 133*a* for a first user or user entity, user account data 133*b* for a second user, and user account data 133*n* for a nth user) for individually authenticating users, associating appropriate accounts with users, determining functionality available to users, etc. to facilitate user directed value operations using the data representing value stored by vault files 132*a*-132*n*.

In addition to the systems of primary site 110 operable for serving user directed value operations, systems of primary site 110 provide ancillary operations. Accordingly, ancillary servers 120 may provide functionality useful in performing user directed value operations, used in combination with user directed value operations, supplementing user directed value operations, etc. Ancillary servers 120 of the illustrated embodiment are shown to include address management service (AMS) server 120*a* and rating server 120*b*. AMS server 120*a* of embodiments is operable for providing address correction, completion, updating, etc. (e.g., using address data stored in database 121*a*) in association with postage indicia generation processing using postage meter value controlled by postal servers 130. Rating server 120*b* of embodiments is operable for providing postal rate calculations (e.g., using rating tables stored in database 121*b*) in association with postage indicia generation processing using postage meter value controlled by postal servers 130.

Other systems may be included with respect to primary site 110 for providing desired operations. For example, network appliance 140 is shown in the illustrated embodiment providing network communication management for facilitating desired operations with respect to AMS server 120*a*, rating server 120*b*, and postal servers 130. Such network communication management may comprise data switching/routing, load balancing, firewalling, network security, network bridging, etc. Network appliance 140 may comprise one or more separate devices according to embodiments of the invention. Additionally or alternatively, functionality of network appliance 140 may be combined with other systems (e.g., ancillary servers 120, postal servers 130, etc.) of primary site 110.

Users, as may be operating a user terminal (e.g., user terminals 102*a* or 102*b*) in communication with systems of primary site 110 via network 101, may thus be enabled to perform user directed value operations, such as generating and printing postage indicia, replenishing postage meter value, etc. Additional detail with respect to operation to provide such user directed value operations as may be provided according to embodiments herein is provided in the above referenced United States patents entitled "System and Method for Remote Postage Metering" and "Virtual Security Device."

User terminals 102 utilized herein may comprise various configurations of processor-based systems adapted for communication with systems of primary site 110 and alternate site 150 via network 101. For example, user terminals 102 may comprise personal computer systems (PCs) (e.g., laptop computers, desktop computers, netbook computers, tablet computers, etc.), personal digital assistants (PDAs) (e.g., an IPAD available from Apple Computer, Inc., a BLACKBERRY available from Research In Motion, Inc., a PALM available from Palm, Inc., etc.), smart phones (e.g., a IPHONE available from Apple Computer, Inc., a DROID available from Motorola, Inc., etc.), and/or the like. Network 101 of embodiments is adapted to provide data communication and may comprise networks such as local area networks (LANs), metropolitan area networks (MANs), wide area networks (WANs), the Internet, an intranet, an extranet, the public switched telephone network (PSTN), cable transmission systems, wireless networks, cellular communications networks, and/or the like.

It should be appreciated that the illustrated configuration of systems of primary site 110 is merely exemplary of the particular systems that may be implemented by such a primary site. Accordingly, embodiments may comprise more, fewer, and/or different value operations servers than postal servers 130*a* and 130*b* of the illustrated embodiment. Likewise, embodiments may comprise more, fewer, and/or different ancillary servers than AMS server 120*a* and rating server 120*b* of the illustrated embodiment. Moreover, various ones of these and/or other servers, or the functionality provided thereby, may be combined rather than provided in separate server configurations as shown in the illustrated embodiment.

In operation of the systems of primary site 110 to provide postage metering services the data or state of vault files for each PSD for which a transaction has occurred will change. Accordingly, postal servers 130*a* and 130*b*, and database 131 associated therewith, of embodiments comprise user transaction servers wherein changes in the data are made in response to user interaction. In contrast, the data or states of data of AMS server 120*a* and rating server 120*b* remains unchanged from user transactions. That is, although master address data stored by database 121*a* of AMS server 120*a* and/or the rating tables stored by database 121*b* of rating server 120*b* may be periodically updated or revised (e.g., by a service provider operating primary site 110), user transactions may access this data without altering it. Thus, AMS server 120*a* and rating server 120*b*, and databases 121*a* and 121*b* associated therewith, of embodiments comprise user transaction servers wherein changes in the data are not made in response to user interaction.

It is typically necessary to duplicate the information associated with changes to data at user transaction servers resulting from user interaction if continuity of system operation is to be provided for uninterrupted user interaction. However, an appreciable number of data entries may be changed in association with each transaction (e.g., an ascending register, a descending register, and a strike counter for each PSD for which a transaction has occurred). This coupled with security measures (e.g., cryptographic protection, data for fraud detection, etc.) taken to protect the data representing value can result in appreciable data associated with the transaction based changes, particularly in situations where a large number of users (e.g., hundreds of thousands of subscribers to a remote postage metering service) are actively using the system.

If systems of an alternate site were established to mirror the systems of primary site 110 a significant amount of data may need to be exchanged (e.g., updated vault files for each PSD for which a transaction has occurred). The need to transmit voluminous data may prove problematic both to generate and transmit in real-time. Moreover, the procedures mandated by an associated entity (e.g., postal service) may proscribe or otherwise restrict particular activities implemented in such a mirroring technique.

Accordingly, systems of alternate site 150 of embodiments of the invention are adapted to serve user directed value operations (e.g., in the event of unavailability of systems of primary site 110) with little or no data replication between primary site 110 and alternate site 150. For example, embodiments of the systems of alternate site 150 are operable to provide continuity of user directed postage meter value operations without implementing duplication of individual user's postage meter value stored by systems of primary site 110. Instead, systems of alternate site 150 of embodiments provide user directed postage meter value operations by alternatively using a service provider's postage meter value stored by systems of alternate site 150.

Postal servers 170 of alternate site 150 may thus be configured to control postage meter value responsive to user requests, thereby providing remote postage metering services similar to those provided by systems of primary site 110. Additionally, ancillary servers 160 (shown comprising AMS server 160*a* having database 161*a* and rating server 160*b* having database 161*b*) of the illustrated embodiment of alternate site 150 are operable to provide ancillary operations corresponding to those provided by ancillary servers 120 of primary site 110. Other systems may be included with respect to alternate site 150 for providing desired operations, such as network appliance 180 providing network communication management corresponding to that of network appliance 140 of primary site 110.

Like postal servers 130 of primary site 110, postal servers 170 of alternate site 150 may comprise crypto-cards or similar secure hardware (not shown) operable with one or more vault files (shown as vault files 172*a*-172*m* stored by database 171) to provide virtual PSD operation for metering postage value for a plurality of users. Vault files 172*a*-172*m* provide a pool of data representing value available for use by appropriate users, but which is not owned by or associated with any particular user or users. In operation of postal servers 170 any of vault files 172*a*-172*m* may be loaded into the crypto-card of a postal server to configure the crypto-card as a PSD for use in association with any user according to embodiments of the invention. Users, as may be operating a user terminal (e.g., user terminals 102*a* or 102*b*) in communication with systems of alternate site 150 via network 101, may thus be enabled to perform user directed value operations, such as generating and printing postage indicia, replenishing postage meter value, etc. using the systems of alternate site 150. Such use of the systems of alternate site 150 may be transparent to the users (e.g., a user may not be aware that the user is accessing data representing value from a pool made available by alternate site 150 rather than individual data representing value made available by primary site 110.

It should be appreciated that the number of PSDs at alternate site 150 (represented by vault files 172*a*-17*m*) need not correspond to the number of user accounts being serviced. That is, there need not be a one-to-one relationship between PSD and user account. The number of PSDs used at alternate site 150 may be chosen as a number determined to be sufficient to serve the demands of the users for which continuity of postage metering service is to be provided.

Continuity of operation provided by alternate site 150 of embodiments is provided using a relatively small amount of data shared between systems of primary site 110 and systems of alternate site 150. For example, embodiments of the present invention operate to update user balance data at systems of alternate site 150 (e.g., user balance data 174 stored in database 171) as user directed value operations are performed using systems of primary site 110. The information shared in real-time between systems of primary site 110 and systems of alternate site 150 according to embodiments thus may include user balance data regarding a remaining balance of data representing value for individual users (e.g., user balance 174*a* for a first user or user entity, user balance 174*b* for a second user or user entity, and user balance 174*n* for a nth user) and information for associating the user balance data with their respective user accounts (e.g., account identification information, user identification information, etc.).

Data shared between systems of primary site 110 and systems of alternate site 150 according to embodiments may include information in addition to the aforementioned user balance data and information for associating the user balance data with respective user accounts. For example, user account data (e.g., user account data 173 stored in database 171), such as may include user identification (e.g., user, user entity name, etc.), user account credentials (e.g., password, digital signature, cryptographic key, user terminal fingerprint, etc.), user account parameters (e.g., account restrictions, account features, etc.), and/or the like, may be shared between systems of primary site 110 and systems of alternate site 150 to facilitate user directed value operations using the alternate data representing value. Accordingly, user account data may comprise information (e.g., user account data 173*a* for a first user or user entity, user account data 173*b* for a second user, and user account data 173*n* for a nth user) for individually authenticating users, associating appropriate accounts with users, determining functionality available to users, etc. This user account data or updates thereto may be shared in non-real-time, such as periodically (e.g., hourly or daily). Moreover, the aforementioned user account data is updated less often than the transactional data and thus is likely to present less of a burden on the systems of primary site 110 and alternate site 150 even if shared in real-time.

Using the foregoing user balance data and user account data in accordance with embodiments of the invention, a relatively small amount of data shared between systems of primary site 110 and systems of alternate site 150, particularly in real-time. For example, data representing value, vault files, large amounts of transactional data, etc. need not be shared between primary site 110 and alternate site 150 to provide continuity of operation, as will be better understood from the discussion which follows.

In operation of systems of alternate site 150 according to embodiments of the invention, a user is provided credit in an amount corresponding to their user balance for performing user directed postage meter value operations while the systems of primary site 110 are unavailable. The use of user balance data as implemented according to embodiments of the invention provides users with access to pooled value stored by vault files 172*a*-172*m*, although those vault files store value which is not owned by or otherwise associated with the users and despite the users being unable to access the value of their associated ones of vault files 132*a*-132*n* stored by systems of primary site 110. The access to value provided by systems of alternate site 150 of embodiments of the invention is thus not contingent upon replicating the data representing value stored by systems of primary site 110.

It should be appreciated that the use of user balance data for accessing data representing value stored by systems of alternate site 150 according to embodiments provides a layer between the user and the data representing value to manage the user balance data which is not present with respect to operations using individual data representing value as stored by systems of primary site 110. Such a user balance credit management layer of embodiments facilitates the use of user balance information for value debit operations, value credit operations, value inquiry operations, etc.

Figure 2:
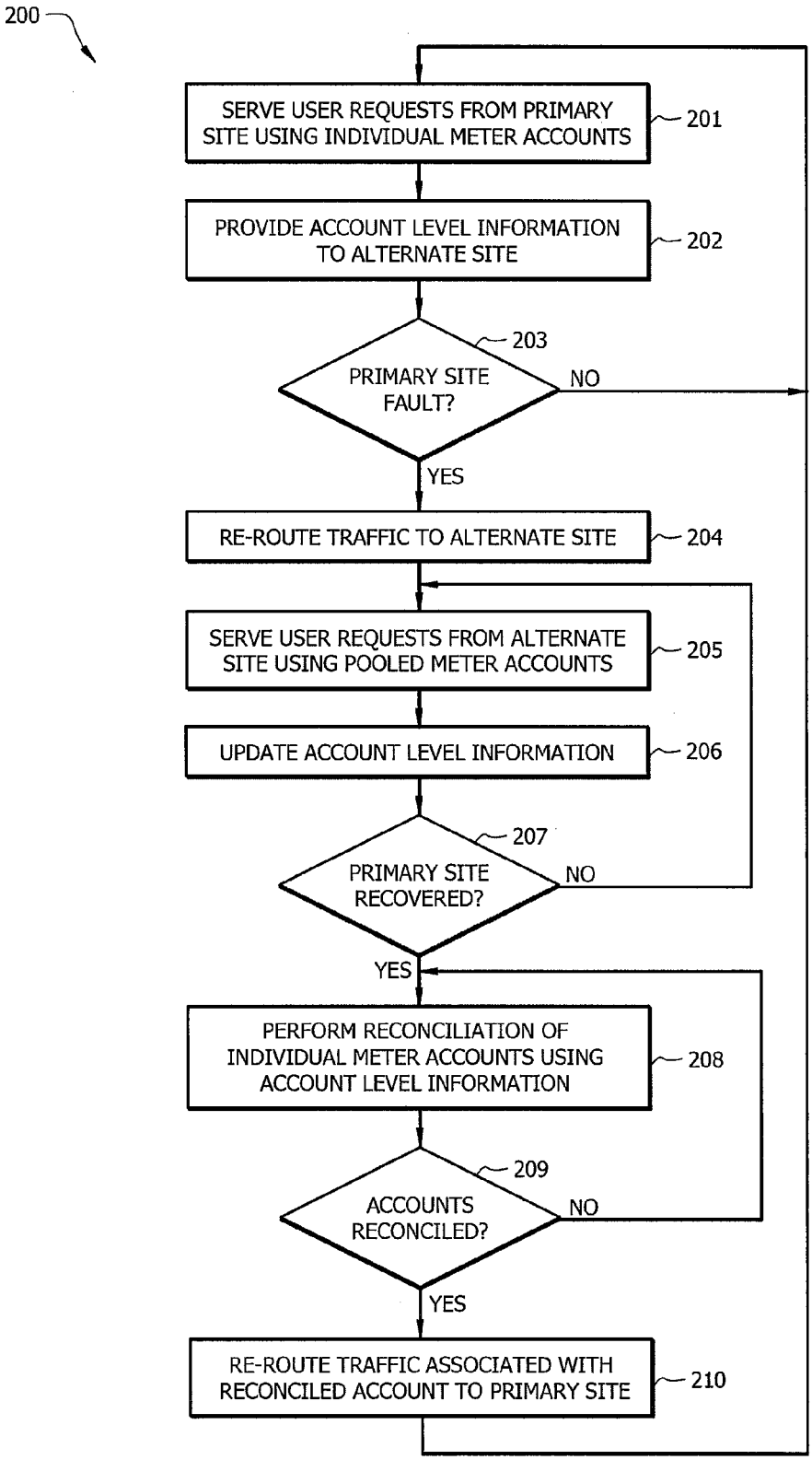
FIG. 2 shows a flow diagram of operation of the system of FIG. 1 in accordance with embodiments of the invention.

Having described embodiments of components of system 100 of FIG. 1, attention is directed to FIG. 2 wherein a flow diagram of operation of system 100 in accordance with embodiments of the invention is shown. Specifically, flow 200 setting forth operation of systems of primary site 110 and alternate site 150 of embodiments is shown. It should be appreciated that the particular functions performed and the order in which particular functions are performed are exemplary and may be different in alternative embodiments.

Prior to operation of flow 200 it is assumed that individual users have established or otherwise been associated with user accounts and that those accounts have data representing value stored by systems of primary site 110 for use in providing user directed value operations. For example, user account data 133 stored in database 131 comprises user account data 133*a* for a first user or user entity, user account data 133*b* for a second user, and user account data 133*n* for a nth user for individually authenticating users, associating appropriate accounts with users, determining functionality available to users, etc. to facilitate user directed value operations using the data representing value stored by vault files 132*a*-132*n*. It is also assumed that the various other systems of system 100 have been appropriately provisioned. For example, postal servers 130 and 170 have been provided with appropriate postage server software (the server software of postage servers 170 differing from postage servers 130 at least due to providing a user balance credit management layer as discussed herein) and the aforementioned user data, ancillary servers 120 and 160 have been provided with server software appropriate to their functionality and with corresponding data, network appliances 140 and 180 have been properly configured, and user terminals 102 have been provided with appropriate postage client software.

It should be appreciated that, when implemented in software, elements of embodiments of the present invention are essentially code segments operable upon a computer system, such as computer systems forming appropriate ones of ancillary servers 120 and/or 160, postal servers 130 and/or 170, and/or user terminals 102, to perform operations as described herein. The program or code segments can be stored in a computer readable medium, such as random access memory (RAM), read only memory (ROM), flash memory, optical memory, magnetic memory and/or the like. Additionally or alternatively, the code segments may be downloaded via computer networks, such as network 101.

At block 201 of the illustrated embodiment systems of primary site 110 are used to serve user requests. For example, a user utilizing a user terminal of user terminals 102 may interact with a postage metering client to request postage indicia, purchase postage value for increasing an associated postage meter account, inquire regarding postage meter value balance, etc. In response, one of postal servers 130*a* and 130*b* may use particular account data of user account data 133 to validate the user and select an appropriate vault file of vault files 132 for use in providing postage metering services. The user may then perform user directed postage meter value operations using the selected vault file of vault files 132, such as generate postage indicia resulting in a decrease in the value of the data representing value, purchase additional postage value resulting in an increase in the value of the data representing value, requesting a value balance resulting in no change in the value of the data representing value, etc. For example, data representing value may be debited in an amount of postage indicia requested by the user and a postage indicia representative of that value may be generated (e.g., a information based indicia (IBI) as accepted by the USPS). Similarly, value may be purchased by the user and the data representing value may be incremented in an amount of value purchased.

At block 202 of the illustrated embodiment, having completed one or more user directed postage meter value operation transaction(s) at block 201, updated user balance data is provided to systems of alternate site 150. For example, one of postal servers 130 serving the user requests may communicate updated user balance data (e.g., a current amount of value represented by the data representing value associated with a user, an amount of change to the amount of value represented by the data representing value associated with a users, etc.) to systems of alternate site 150 (e.g., one of postal servers 170) via network 101. In operation according to preferred embodiments of the invention, updated user balance data is provided by systems of primary site 110 to systems of alternate site 150 only with respect to changes in the monetary amount of the user balance (e.g., changes in the data are made in response to user interaction). A user requesting a value balance, which does not result in a change in the monetary amount or value of the data representing value, would not result in updated user balance data being provided to systems of alternate site 150 according to embodiments of the invention. However, such transactions which do not actually result in changes to data of the transaction servers which otherwise accommodate transaction based data changes may result in updated data being provided to systems of alternate site 150, such as to provide robust tracking or access information, according to embodiments.

The communication of updated user balance data is preferably done in real-time or near real-time in association with transactions affecting the user account balance. Embodiments may, for example, provide communication of updated user balance data at the database layer (e.g., as a corresponding entry of database 131 is updated), at a disk level (e.g., as a data file containing a corresponding entry is updated), or at a operating system level (e.g., as the operating system or server software detects corresponding data being updated). Accordingly, the updated user balance data is provided to systems of alternate site 150 to facilitate a recovery point on the order of seconds (e.g., the latency associated with collecting and transmitting user balance update information upon completion of a transaction).

It should be appreciated that the data shared by systems of primary site 110 with systems of alternate site 150 at block 202 of embodiments may include data in addition to the aforementioned updated user balance data. For example, user account identification data for use in associating the updated user balance data with an appropriate user account may be communicated by systems of primary site 110 to systems of alternate site 150 at block 202. However, large amounts of data associated with the users' interaction with systems of primary site 110 (e.g., updated vault files of vault files 132, ascending registers, strike counters, etc.) are not communicated to systems of alternate site 150. Accordingly, the data stored in database 171 of alternate site 150 will not mirror the data stored in database 131 of primary site 110 even after the communication of the foregoing updated data in accordance with operation of embodiments of the invention.

Moreover, data which is not changed in association with user transactions (e.g., changes in the data are not made in response to user interaction) may be provided to systems of alternate site 150 less frequently than the user balance discussed above. For example, the data of AMS server 120*a* and rating server 120*b* remains unchanged from user transactions. Similarly, user account data 133 stored in database 131 may remain unchanged for relatively long periods of time. Accordingly, updates to some or all of this information may be provided to systems of alternate site 150 periodically (e.g., in parallel with the corresponding information being updated at ancillary servers 120 of primary site 110, in batch, as user account data is changed). That is, master address data stored by database 161 a of AMS server 160*a*, the rating tables stored by database 161*b* of rating server 160*b*, and/or user account data 173 stored in database 171 may be periodically updated or revised (e.g., by a service provider operating alternate site 150) independent of the updating of user balance data herein.

At block 203 of the illustrated embodiment a determination is made regarding whether the systems of primary site 110 remain available for use by users. For example, a failure of one or more systems of primary site 110, a network communication interruption, an interruption in power to the systems of primary site 110, etc. may render the systems unsuitable or unavailable for use in user directed postage metering value operations (i.e., result in a "fail-over" situation). If no such event is detected or systems of primary site 110 are otherwise determined to be available, processing according to the illustrated embodiment returns to block 201 for operation to serve further user requests by systems of primary site 110. However, if such an event is detected or systems of primary site 110 are otherwise determined to be unavailable, processing according to the illustrated embodiment proceeds to block 204 for processing to provide continuity of operation using systems of alternate site 150.

At block 204 of the illustrated embodiment user communication traffic is rerouted to systems of alternate site 150 to facilitate user directed postage metering operations using systems of alternate site 150. For example, devices of network 101 (e.g., routers, switches, bridges, etc.) and/or network appliances 140 and 180 may be instructed to route communication traffic directed to systems of primary site 110 to systems of alternate site 150. Accordingly, users are transparently redirected to systems of alternate site 150 upon a fault at the systems of primary site 110 according to embodiments of the invention.

At block 205 of the illustrated embodiment systems of alternate site 150 are used to provide continuity of operation and serve user requests. Embodiments of the invention may provide a message or other notification to the user that systems of alternate site 150 are providing the value operations rather than systems of primary site 110, such as to provide notice in case of an operational difference observed by a user (e.g., user balance data is slightly out of date due to updated user balance data not having been communicated to the systems of alternate site 150 at the time of the fail-over event). Alternatively, embodiments of the invention may provide no notification to the user that systems of alternate site 150 are providing the value operations in order to provide as transparent fail-over and continuation of postal metering operations as possible to the user.

Similar to user directed value operations conducted using systems of primary site 110, a user utilizing a user terminal of user terminals 102 may interact with a postage metering client to request postage indicia, purchase postage value for increasing a postage account balance, inquire regarding postage meter account balance, etc. using systems of alternate site 150. However, rather than accessing data representing value associated with a particular user, one of postal servers 170*a* and 170*b* may use particular account data of user account data 173 to validate the user and use associated data of user balance data 174 to determine a credit in an amount corresponding to their user balance for performing user directed value operations using the systems of alternate site 150. The postal server may then operate to select a vault file from the pool of vault files 172 (e.g., a vault file having sufficient value stored therein) for use in providing postage metering services. The user may then perform user directed postage meter value operations, such as generate postage indicia, purchase additional postage value, requesting a value balance, etc.

The user balance data of embodiments essentially provides a credit balance to users in the amount of the value of their data representing value, or some other basis for providing a credit balance, in order to access value of the pool of vault files 172 (e.g., in an amount commensurate with the users' value) according to embodiments of the invention.

Accordingly, operation at block 205 of embodiments implements a credit layer between the user and the data representing value by postage servers 170 to manage the user balance data which is not present with respect to operations using individual data representing value by postage servers 130 of primary site 110. It should be appreciated that the credit balance provided by systems of alternate site 15 for accessing data representing value stored thereby may be initially set as an amount equal to the monetary amount of the data representing value stored by systems of primary site 110, a monetary amount initially different than the monetary amount of the data representing value stored by systems of primary site 110 (e.g., determined based upon or as some function of the monetary amount of the data representing value stored by systems of primary site 110), a monetary amount initially unrelated to than the monetary amount of the data representing value stored by systems of primary site 110 (e.g., set based upon a customer level metric), etc. For example, the credit balance initially provided by systems of alternate site 150 may be determined from the frequency of use of the service (e.g., frequency of user balance data transmissions from systems of primary site 110 to systems of alternate site 150, wherein a higher frequency of use may be concluded to be a higher customer level worthy of an increased credit balance), the aggregate magnitude of transactions over some period of time (e.g., monetary amount of user balance data in a month, wherein a higher monetary amount of the user balance data in the period may be concluded to be a higher customer level worthy of an increased credit balance), etc. User balance data 174, irrespective of how it is initially established, is preferably incremented (credited) and decremented (debited) by operation of servers 170 in accordance with the postage meter value operations performed using systems of alternate site 150.

Embodiments of the systems of alternate site 150 may operate to update and/or store information in addition to the aforementioned user balance data. For example, postal servers 170 of embodiments may operate to store transactional data in association with the particular users (e.g., as part of user account data 173 and/or user balance data 174), such as for transaction historical detail, reporting, use in refunds for unused or misprinted postage indicia, etc. Such information may comprise the user's then current user balance data, the particular PSD used for the value operation (e.g., identified by the particular vault file of fault files 172 used), a print or strike log (e.g., a log of indicia prints initiated by the user using the alternate site, possibly comprising information such as user information, meter information, date information, value information, register information, etc. the transactional data may be used for transaction historical detail, reporting, use in refunds for unused or misprinted postage indicia, etc.), then current register information for the PSD used (e.g., ascending register, descending register, strike counter, etc.), time/date information, user terminal fingerprint, user account information, etc.

It should be appreciated, because the users' individual data representing value is not being accessed by operation of the systems of alternate site 150 of embodiments, that user directed postage metering value operations generating postage indicia do not result in a decrease in the value of the users' data representing value, purchasing additional postage value do not result in an increase in the value of the users' data representing value, and requesting a value balance do not result in accessing the value of the users' data representing value. Operations which would otherwise increase or decrease the value of the users' data representing value instead provide a corresponding increase or decrease in the user balance data associated with the user (e.g., user balance 174*a* for a first user or user entity, user balance 174*b* for a second user or user entity, and user balance 174*n* for a nth user).

A service provider operating systems of alternate site 150 may accept payment from a user to increase the user balance data associated with the user and thus increase the credit toward the value of the pool of vault files 172 available to the user. It should be appreciated that a service provider may manage the value of the pool of vault files 172 independent of such payment by users (e.g., the service provider may "top up" the value of any of vault files 172*a*-172*m* based upon their use, irrespective of payments for additional credit made by users) according to embodiments of the invention. Alternatively, a service provider may manage the value of the pool of vault files 172, at least in part, in response to payment by users (e.g., the service provider may perform a credit operation with respect to one or more of vault files 172*a*-172*m* in response to payment for additional credit made by users), if desired.

At block 206 of the illustrated embodiment the user balance data is updated to reflect any changes resulting from the user directed postage metering value operations. For example, a particular one of the user balance data 174 is updated to reflect changes in a corresponding user's balance as a result of their use of systems of alternate site 150.

At block 207 of the illustrated embodiment a determination is made regarding whether the systems of primary site 110 remain unavailable for use by users. For example, recovery of a failed one or more systems of primary site 110, cessation of a network communication interruption, recovery of power to the systems of primary site 110, etc. may render the systems available or otherwise suitable for use again in user directed postage metering value operations. If no such event is detected or systems of primary site 110 are otherwise determined to continue to be unavailable, processing according to the illustrated embodiment returns to block 205 for operation to serve further user requests by systems of alternate site 150. However, if such an event is detected or systems of primary site 110 are otherwise determined to be available, processing according to the illustrated embodiment proceeds to block 208 for processing to reconcile individual users' data representing value stored by systems of primary site 110 with user balance data stored by systems of alternate site 150.

At block 208 of the illustrated embodiment processing is provided to reconcile individual users' data representing value stored by systems of primary site 110 with user balance data stored by systems of alternate site 150. In operation according to embodiments of the invention such reconciliation processing is performed for each user's account prior to returning user directed postage metering value operation processing for that user to systems of primary site 110. That is, user directed postage metering value operations may be returned to systems of primary site 110 on a user by user basis as reconciliation processing for those particular users is performed. For example, network appliance 180 may be instructed to redirect user requests associated with users for which reconciliation has been completed to systems of primary site 110 while directing user requests associated with users for which reconciliation has not been completed to systems of alternate site 150. Accordingly, as user requests are directed by devices of network 101 to alternate site 150 (e.g., in accordance with the rerouting of user communication traffic at block 204), network appliance 180 may identify the particular user account with which the request is associated and make a determination regarding whether the account has been reconciled (thus redirecting the user request to systems of primary site 110) or not (thus allowing the user request to pass to systems of alternate site 150).

Reconciliation of individual users' data representing value stored by systems of primary site 110 with user balance data stored by systems of alternate site 150 according to embodiments comprises value operations with respect to the appropriate data representing value stored by systems of primary site 110. For example, where the user balance data stored by systems of alternate site 150 reflects a balance less than the value of the associated user's data representing value stored by systems of primary site 110, a value debit operation may be conducted with respect to the data representing value in the amount of the difference. In operation according to embodiments of the invention, one of postal servers 130*a* and 130*b* may use account data of user account data 133 to select an appropriate vault file of vault files 132 (e.g., vault file 132*a* for a first user or user entity, vault 132*b* for a second user or user entity, etc.) for loading into the crypto-card for accessing the users' data representing value stored in the vault file. Thereafter, a value debit operation may be performed with respect to the data representing value to reconcile the value stored with that of the user balance data.

The foregoing reconciliation processing preferably results in an indicia of value being generated for use in transferring the value to the service provider operating the systems of alternate site 150 which extended credit to the user. For example, a data packet similar to that of the postage indicia otherwise generated by postal servers 130 (e.g., an IBI value indicia data packet) may be generated to provide trusted and auditable indicia of value. Such a data packet may be in electronic form (e.g., a digital representation of the data) or in physical form (e.g., an indicia printed upon paper or label stock). The value indicia may be utilized in a number of ways to return value to a service provider or systems thereof. For example, the value indicia may be provided to an authority with which the value is associated (e.g., the postal service) for applying credit to a service provider operating the systems of alternate site 150. Such a credit may simply be a credit toward future transactions between the service provider and the authority or may result in value provided to data representing value (e.g., data representing value stored in vault files 172). Alternatively, the value indicia may be provided to systems of alternate site 150 (e.g., postal servers 170) for processing to provide value to data representing value stored in vault files 172.

Where the user balance data stored by systems of alternate site 150 reflects a balance greater than the value of the associated user's data representing value stored by systems of primary site 110, a value credit (value incrementing) operation may be conducted with respect to the data representing value in the amount of the difference. In operation according to embodiments of the invention, one of postal servers 130*a* and 130*b* may use account data of user account data 133 to select an appropriate vault file of vault files 132 (e.g., vault file 132*a* for a first user or user entity, vault 132*b* for a second user or user entity, etc.) for loading into the crypto-card for accessing the users' data representing value stored in the vault file. Thereafter, a value credit operation may be performed with respect to the data representing value to reconcile the value stored with that of the user balance data.

It should be appreciated that the service provider operating the systems of alternate site 150 would have already been paid by the user for the purchase of the additional credit resulting in the user balance data being greater than the value of the data representing value according to embodiments as discussed above. Accordingly, a service provider operating systems of primary site 110 and alternate site 150 may conduct a credit operation with respect to a particular vault file 130 associated with the user without requesting additional monies from that user for accomplishing reconciliation processing. Such credit operations may comprise a refill operation as typically performed by the user (e.g., a refill operation using a postal system value server, without the user providing additional payment) or may utilize techniques for the transfer of value otherwise held by the service provider (e.g., utilize credit transfer operations from one or more of vault files 170 to appropriate ones of vault files 130 using indicia of value as discussed above with respect to debiting users data representing value for reconciliation) according to embodiments of the invention.

Processing to provide reconciliation may comprise manipulation of data in addition to the aforementioned data representing value. For example, transactional data stored in association with the particular users (e.g., as part of user account data 173 and/or user balance data 174) may be provided to systems of primary site 110 (e.g., for storage as part of account data 132). The transactional data may be used for transaction historical detail, reporting, use in refunds for unused or misprinted postage indicia, etc. This transactional data may be utilized by systems of primary site 110 for providing transactional data/historical data bridging a period in which systems of alternate site 150 were used to provide continuity of postage metering operation. For example, print or strike log information stored by the systems of the alternate site may be used to update or supplement print or strike log information stored by systems of the primary site to thereby provide historical information bridging the interruption in service by the primary site.

At block 209 of the illustrated embodiment a determination is made regarding whether all the individual users' data representing value stored by systems of primary site 110 have been reconciled with the corresponding user balance data stored by systems of alternate site 150. If the all the data representing value stored by systems of primary site 110 has not been reconciled, processing according to the illustrated embodiment returns to block 208 for continued reconciliation processing and identification of user requests to be served by systems of alternate site 150 or systems of primary site 110. However, if all the data representing value stored by systems of primary site 110 has been reconciled, processing according to the illustrated embodiment proceeds to block 210.

At block 210 of the illustrated embodiment user communication traffic is again routed to systems of primary site 110 to facilitate user directed postage metering operations using systems of primary site 110. For example, devices of network 101 (e.g., routers, switches, bridges, etc.) and/or network appliances 140 and 180 may be instructed to route communication traffic previously redirected to systems of remote site 150 to systems of primary site 110. Accordingly, users are transparently returned to normal operation of systems of primary site 110 after use of systems of alternate site 150 to provide continuity of postage metering operation according to embodiments of the invention.

It should be appreciated that a refund for an unused postage indicia or miss-printed postage indicia generated using a PSD associated with a vault file of vault files 170 may be returned to the value stored by the particular value file used after return of operations to systems of primary site 110. Because the user directed operations were returned to the systems of primary site 110 after the postage indicia at issue is generated using systems of alternate site 150, the service provider operating alternate site 150 receives the refunded value without the user's balance data (and thus the user's data representing value) being appropriately credited. The aforementioned techniques for the transfer of value for reconciliation of user balance data and the user's data representing value may be utilized to transfer the refund to the user's data representing value (e.g., after reconciliation for return of operations to the systems of primary site 110).

From the foregoing, it can be appreciated that systems of primary site 110 and systems of alternate site 150 adapted according to embodiments of the invention are operable to meet relatively short recovery time and recovery point objectives. For example, systems of alternate site 150 are preferably operated in a standby mode for immediate redirection of user requests in the event of the unavailability of systems of primary site 110, thereby proving a recovery time on the order of seconds (e.g., the time for instructing routers or other network equipment to redirect communications). Systems of alternate site 150 are additionally or alternatively provided updated information for facilitating user directed value operations in real-time or near real-time (e.g., as user transactions are completed) by systems of primary site 110, thereby providing a recovery point on the order of seconds (e.g., the latency associated with collecting and transmitting user balance update information upon completion of a transaction).

In providing updating of information in real-time or near real-time as set forth in the illustrated embodiments of flow 200 discussed above, wherein user balance information is replicated to facilitate user directed value operations using the alternate data representing value stored by systems of alternate site 150, continuity of operation of system 100 is provided using relatively little data replication between primary site 110 and alternate site 150 in real-time or near real-time. It should be appreciated, however, that the concepts herein may be applied to embodiments wherein no data is replicated between primary site 110 and alternate site 150 in real-time or near real-time. For example, embodiments of the invention may omit the providing of user balance data to systems of alternate site 150. Accordingly, in a fail-over situation, a user may be provided some amount of credit (e.g., based upon user history, user account type, etc.) for utilizing value stored by systems of alternate site 150. Additionally or alternatively, a user may provide payment to purchase an amount of credit for utilizing value stored by systems of alternate site 150 in the case of a fail-over. In particular embodiments wherein a user provides payment for an initial amount of credit for utilizing value stored by systems of alternate site 150 no data replication between primary site 110 and alternate site 150 may be implemented. For example, the user may establish new user account data at alternate site 150 upon initial payment rather than having such account data provided by systems of primary site 110 as discussed above.

Embodiments of a system adapted to provide continuity of system operation using relatively little or no data replication between a primary site and an alternate site have been shown above wherein the configuration of the primary site and alternate site are asymmetrical. In asymmetrical system configurations a primary site may provide resources (e.g., PSDs) for each user or user account while an alternate site may provide resources which are shared among users or user accounts. Accordingly, a code base for implementing the functionality at the primary site may differ significantly from a code base for implementing the functionality at the alternate site. Such a configuration presents a challenge with respect to testing and maintaining the sites. For example, the primary site may be tested one way while the alternate site may be tested another way.

Accordingly, alternative embodiments of the invention may continuity of system operation utilizing more symmetrical configurations between a primary site and an alternate site. In accordance with a more symmetrical configuration of an embodiment of the invention, the alternate site comprises PSDs and/or other resources corresponding to PSDs and/or other resources of the primary site. For example, for each user or user account having a PSD at the primary site a PSD is also present at the alternate site. That is, each user or user account of embodiments has two PSDs associated therewith, one for the primary site and one for the alternate site. The data of the PSDs, however, is not replicated between the primary site and alternate site to provide transaction synchronization. Instead, user balance data is provided between the primary site and the alternate site, as discussed above, to provide continuity of system operation using relatively little or no data replication between a primary site and an alternate site. Accordingly, the alternate site PSDs may have no postage meter value stored therein. In operation of this alternative embodiment, when systems of the primary site are inoperable, users are redirected to systems of the alternate site. However, when those users interact with the systems of the alternate site, PSDs and/or other resources associated with the user or user account (as opposed to shared resources) are utilized by each user.

In operation of the systems of the alternate site, the user is able to view available postage amounts and otherwise access account information from the use balance data and other user postage meter account data replicated at the alternate site. When a user interacts with the alternate site for remote postage metering operations, such as to obtain a postage indicium, the user's account balance is accessed and, assuming a sufficient balance is present, the user's PSD at the alternate site is funded with an amount corresponding to that of the postage value desired to thereby allow the alternate site PSD operate as described above to provide postage meter value. The user's account balance is debited in the amount of the postage value metered, and the user's PSD at the alternate site again has no postage meter value stored therein after the operation. Accordingly, the user's account balance is utilized to provide credits on a transaction by transaction basis to facilitate operation of the alternate site PSD.

If a user depletes their account balance, or otherwise desires to purchase postage meter value, while operations are performed using the alternate site, value obtained by the user is stored by that user's PSD. That is, the user's PSD at the alternate site would be incremented by an amount appropriate to the purchased value and thus would store value. Metering operations would decrement this value, as described above, during continued operation of the alternate site.

When the primary site is again restored to operating status, users may be redirected to the systems of the primary site, as discussed above. The above described reconciliation techniques may be utilized to adjust the PSDs of the primary site in correspondence to the operations performed using the systems of the alternate site.

As can be seen from the discussion above, the foregoing alternative embodiment provides a more symmetrical configuration of primary site and alternate site, although there remains some asymmetry. Nevertheless, testing and maintenance of the systems using identical or very similar techniques is facilitated.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method comprising:

storing, by systems of a primary site, a first amount of monetary value in a user account owned by a user;

storing, by systems of an alternative site, a second amount of monetary value owned by another;

performing, by the systems of the primary site in response to user requests that originated from a remote user terminal, secure postage transactions that change the first amount of monetary value;

as the secure postage transactions are completed, backing up the systems of the primary site by sending the systems of the alternative site user balance information that indicates the first amount of monetary value;

failing-over, in response to the systems of the primary site become unavailable, the secure postage transactions to the systems of the alternative site, wherein the failing-over comprises the alternative site performing the following failing-over operations:

prior to the alternative site performing failing-over secure postage transactions for the user, initializing the failing-over at least by:

creating a credit layer, designated to the user, that manages the failing-over secure postage transactions in lieu of the user account during the failing-over;

determining a credit in an amount corresponding to the user balance information, wherein the credit identifies an amount of the second amount of monetary value that is accessible by the user in performing the failing-over secure postage transactions during the failing-over; and assigning the credit to the credit layer designated to the user during the failing-over;

after the initializing, performing the failing-over secure postage transactions at least by:

performing, in response to requests from the user that originated from the remote user terminal, failing-over secure postage transactions that cause changes to the second amount of monetary value during the failing-over; and adjusting the credit of the credit layer to reflect the changes to the second amount of monetary value that were caused by the user during the failing-over; and in response to the systems of the primary site becoming available, the alternative site concluding the failing-over operations by:

debiting or crediting the first amount of monetary value to reconcile the second amount of monetary value according to the credit's amount at a time of the concluding; and in response to the reconciling being complete, re-routing traffic associated with the user account to the primary site.

2. The method of claim 1, wherein the secure postage transactions comprise postage indicia generation operations.

3. The method of claim 1, wherein the determining the credit comprises:

determining an initial credit balance to be equal to the first amount of monetary value stored in the user account.

4. The method of claim 1, wherein the determining the credit comprises:

determining an initial credit corresponding to a customer level metric using at least the user balance information.

5. The method of claim 1, wherein the another is a service provider operating the systems of the alternative site.

6. The method of claim 1, wherein the failing-over secure postage transactions comprise a postage indicia generation operation.

7. The method of claim 1, further comprising:

incrementing the credit in an amount corresponding to a payment made by the user during the failing-over operations.

8. The method of claim 1, wherein the change in the first amount of monetary value in the user account comprises an increase in value.

9. The method of claim 1, wherein the change in the first amount of monetary value in the user account comprises a decrease in value.

10. A system comprising:

at least one primary site server storing a first amount of monetary value in a user account owned by a user, the at least one primary site server comprising a first processor and a first memory; and at least one alternative site server storing a second amount of monetary value owned by another, the at least one alternative site server comprising a second processor and a second memory;

wherein the at least one primary site server performs, in response to user requests that originated from a remote user terminal, secure postage transactions that change the first amount of monetary value;

wherein as the secure postage transactions are completed, the at least one primary site server performs a backup by sending the at least one alternative site server user balance information that indicates the first amount of monetary value; and wherein in response to the at least one primary site server becoming unavailable, the at least one alternative site server fails-over the secure postage transactions to the at least one alternative site server, wherein the fail-over comprises:

prior to the at least one alternative site server performing failing-over secure postage transactions for the user, the at least one alternative site server initializes at least by:

the at least one alternative site server creates a credit layer, designated to the user, that manages the failing-over secure postage transactions in lieu of the user account during the fail-over;

the at least one alternative site server determines a credit in an amount corresponding to the user balance information, wherein the credit identifies an amount of the second amount of monetary value that is accessible by the user to perform the failing-over secure postage transactions during the fail-over; and the at least one alternative site server assigns the credit to the credit layer designated to the user during the fail-over;

after the initialization, the at least one alternative site server performs the failing-over secure postage transactions at least by:

the at least one alternative site server performs, in response to requests from the user that originated from the remote user terminal, failing-over secure postage transactions that cause changes to the second amount of monetary value during the fail-over; and the at least one alternative site server adjusts the credit of the credit layer to reflect the changes to the second amount of monetary value that were caused by the user during the fail-over; and in response to the at least one primary site server becoming available, the at least one alternative site server concludes the fail-over by:

the at least one alternative site server debits or credits the first amount of monetary value to reconcile the second amount of monetary value according to the credit's amount at a time of the concluding; and in response to the reconciling being complete, the at least one alternative site server re-routes traffic associated with the user account to the at least one primary site server.

11. The system of claim 10, wherein the at least one primary site server comprises at least one postal server, wherein the at least one alternative site server comprises at least one postal server, and wherein the first amount of monetary value in the user account stored by the at least one primary site server comprises postage value.

12. The system of claim 10, wherein the second amount of monetary value comprises postage value.

13. The system of claim 10, wherein the at least one primary site server and the at least one alternative site server are adapted to cooperate to provide continuity of secure postage transactions despite the first amount of monetary value in the user account stored by the at least one primary site server being unavailable for secure postage transactions.

14. The system of claim 10, wherein the reconciling increases the first amount of monetary value.

15. The system of claim 10, wherein the reconciling decreases the first amount of monetary value.

16. A method comprising:

storing, by systems of a primary site, a first amount of monetary value in a user account owned by a user;

storing, by systems of an alternative site, a second amount of monetary value owned by another;

performing, by the systems of the primary site in response to user requests that originated from a remote user terminal, a first secure postage transaction that changes the first amount of monetary value;

as the first secure postage transaction is completed, backing up the systems of the primary site by sending the systems of the alternative site user balance information that indicates the first amount of monetary value at the time the first secure postage transaction was completed; and failing-over, in response to the systems of the primary site becoming unavailable, secure postage transactions to the systems of the alternative site, wherein the failing-over comprises the systems of the alternative site performing the following failing-over operations:

prior to the systems of the alternative site performing failing-over secure postage transactions for the user, initializing the failing-over at least by:

creating a credit layer, designated to the user, that manages the failing-over secure postage transactions in lieu of the user account during the failing-over;

determining a credit in an amount corresponding to the user balance information, wherein the credit identifies an amount of the second amount of monetary value that is accessible by the user in performing the failing-over secure postage transactions during the failing-over; and assigning the credit to the credit layer designated to the user during the failing-over;

after the initializing, performing a second secure postage transaction at least by:

performing, in response to requests from the user that originated from the remote user terminal, the second secure postage transaction that causes changes to the second amount of monetary value during the failing-over; and adjusting the credit of the credit layer to reflect the changes to the second amount of monetary value that were caused by the user during the failing-over; and in response to the systems of the primary site becoming available, the systems of the alternative site concluding the failing-over operations by:

debiting or crediting the first amount of monetary value to reconcile the second amount of monetary value according to the credit's amount at a time of the concluding; and in response to the reconciling being complete, re-routing traffic associated with the user account to the primary site.

17. The method of claim 16, wherein the first secure postage transaction is a postage indicia generation operation.

18. The method of claim 16, wherein the first amount of monetary value in the user account comprises postage value stored using a postage security device (PSD).

19. The method of claim 16, wherein the credit is initially equal to the first amount of monetary value stored in the user account.

20. The method of claim 16, wherein the credit initially corresponds to a customer level metric determined using at least the user balance information.

21. The method of claim 16, wherein the credit at least holds the user financially liable for the second secure postage transaction performed by the systems of the alternative site.

22. The method of claim 16, wherein the second secure postage transaction comprises a postage indicia generation operation.

23. The method of claim 16, further comprising:

incrementing the credit in an amount corresponding to a payment made by the user during the failing-over.

24. The method of claim 16, further comprising;

after the re-routing, performing a third secure postage transaction at the systems of the primary site.

25. The method of claim 24, wherein the performing the third secure postage transaction at the systems of the primary site changes the first amount of monetary value.

26. The method of claim 16, wherein the change in the first amount of monetary value comprises an increase in value.

27. The method of claim 16, wherein the change in the first amount of monetary value comprises a decrease in value.

* * * * *